US007517916B2

(12) United States Patent
Dierickx

(10) Patent No.: US 7,517,916 B2
(45) **Date of Patent: *Apr. 14, 2009**

(54) PROCESS TO PREPARE LOWER OLEFINS FROM A FISCHER-TROPSCH SYNTHESIS PRODUCT

(75) Inventor: Jan Lodewijk Maria Dierickx, Amsterdam (NL)

(73) Assignee: Shell Oil Company, Houston, TX (US)

( * ) Notice: Subject to any disclaimer, the term of this patent is extended or adjusted under 35 U.S.C. 154(b) by 70 days.

This patent is subject to a terminal disclaimer.

(21) Appl. No.: 11/664,722

(22) PCT Filed: Oct. 6, 2005

(86) PCT No.: PCT/EP2005/055079

§ 371 (c)(1), (2), (4) Date: Apr. 5, 2007

(87) PCT Pub. No.: WO2006/037806

PCT Pub. Date: Apr. 13, 2006

(65) Prior Publication Data

US 2008/0045613 A1 Feb. 21, 2008

(30) Foreign Application Priority Data

Oct. 8, 2004 (EP) ..... 04104947

(51) Int. Cl.
*C07C 27/00* (2006.01)
*C10G 15/00* (2006.01)
*C10G 35/00* (2006.01)

(52) U.S. Cl. ..... 518/700; 518/702; 518/703; 518/704; 208/106; 208/133

(58) Field of Classification Search ..... 518/700–704; 208/106, 133

See application file for complete search history.

(56) References Cited

U.S. PATENT DOCUMENTS

| | | | | |
|---|---|---|---|---|
| 4,498,629 | A | 2/1985 | Grondman | 239/434.5 |
| 4,836,831 | A | 6/1989 | Martens | 48/197 R |
| 4,943,672 | A | 7/1990 | Hamner et al. | 585/737 |
| 5,059,299 | A | 10/1991 | Cody et al. | 208/27 |
| 5,620,670 | A * | 4/1997 | Benham et al. | 422/213 |
| 5,803,724 | A | 9/1998 | Oortwijn et al. | 431/4 |
| 5,931,978 | A | 8/1999 | Ootwijn et al. | 48/127.1 |
| 6,376,732 | B1 | 4/2002 | Ngan et al. | 585/800 |
| 2003/0135077 | A1 | 7/2003 | O'Rear et al. | 585/613 |
| 2004/0004028 | A1 | 1/2004 | Stell et al. | 208/130 |
| 2004/0152793 | A1 * | 8/2004 | O'Rear et al. | 518/726 |

FOREIGN PATENT DOCUMENTS

| | | |
|---|---|---|
| EP | 321305 | 6/1989 |
| EP | 668342 | 8/1995 |
| EP | 759886 | 3/1997 |
| EP | 772568 | 5/1997 |
| EP | 776959 | 6/1997 |
| GB | 791634 | 3/1958 |
| GB | 1461989 | 1/1977 |
| GB | 2371807 | 8/2002 |
| GB | 2386607 | 9/2003 |
| GB | 2388611 | 11/2003 |
| NL | 77129525 | 5/1979 |
| WO | 9920720 | 4/1999 |
| WO | 9934917 | 7/1999 |
| WO | 0166672 | 9/2001 |
| WO | 02070630 | 9/2002 |
| WO | 03036166 | 5/2003 |
| WO | 03062352 | 7/2003 |
| WO | 2004092060 | 10/2004 |
| WO | 2004092062 | 10/2004 |
| WO | 2004092063 | 10/2004 |

OTHER PUBLICATIONS

International Search Report dated Dec. 9, 2005.

* cited by examiner

*Primary Examiner*—Jafar Parsa

(57) ABSTRACT

A process to make ethylene and/or propylene from methane comprises preparing a gaseous mixture of carbon monoxide and hydrogen from methane, performing a Fischer Tropsch synthesis using the gaseous mixture to obtain a Fischer Tropsch product having a 50 wt % recovery point above 250° C., evaporating a part of the Fischer Tropsch product in the presence of a dilution gas comprising the unconverted carbon monoxide and hydrogen from the Fischer Tropsch synthesis step and carbon dioxide into a gas and a liquid fraction and separating the liquid fraction from the remaining gas fraction, further heating the gas fraction and subjecting the gas fraction to a thermal cracking step, isolating a mixture of methane, carbon monoxide and hydrogen from the cracked gases, and recycling the mixture of methane, carbon monoxide and hydrogen to the step of preparing a gaseous mixture.

8 Claims, No Drawings

PROCESS TO PREPARE LOWER OLEFINS FROM A FISCHER-TROPSCH SYNTHESIS PRODUCT

PRIORITY CLAIM

The present application claims priority to European Patent Application 04104947.9 filed 08 Oct. 2004.

FIELD OF THE INVENTION

The invention is directed to a process to prepare lower olefins from a Fischer-Tropsch synthesis product in a steam cracker furnace.

BACKGROUND OF THE INVENTION

It is well known to use the naphtha paraffin product as obtained in a Fischer-Tropsch process as steam cracker feedstock. For example, in "The Markets for Shell Middle Distillate Synthesis Products", Presentation of Peter J. A. Tijm, Shell International Gas Ltd., Alternative Energy '95, Vancouver, Canada, May 2-4, 1995 on page 5, it is mentioned that SMDS naphtha, the Fischer-Tropsch derived naphtha fraction of the Shell MDS process, is used as steam cracker feedstock in for example Singapore.

Because a Fischer-Tropsch derived product contains almost no detectable levels of sulphur, sulphur will have to be added to this feedstock before it can be used as steam cracker feedstock. This may be done by adding a sulphur additive like dimethyl disulphide (DMDS) or by blending the Fischer-Tropsch feed with a high sulphuric content material as described in more detail in 'Preliminary Survey on GTL Business Based on SMDS technology, June 2001, Japan External Trade Organization (JETRO), section 6.2.3.

WO-A-2003062352 discloses a process wherein lower olefins are prepared in a steam cracker furnace designed for petroleum naphtha starting from a Fischer-Tropsch derived gas oil.

US-A-2003/0135077 describes a process wherein a so called Fischer-Tropsch derived syncrude is blended with a sulphur containing petroleum derived naphtha and a treated crude derived fraction boiling above the naphtha boiling range. The petroleum derived naphtha, the Fischer-Tropsch syncrude and the refined heavy petroleum-derived portion are forwarded to a naphtha cracker unit for processing.

A problem of the process of US-A-20030135077 is that such relatively heavy and wide boiling feedstocks will foul the tubes in the convection section preheaters and/or downstream equipment of a steam cracker furnace by coke deposition.

The object of the present invention is to provide a process that can convert a relatively heavy feed comprising a Fischer-Tropsch derived synthesis product into lower olefins.

SUMMARY OF THE INVENTION

The present invention provides a process to prepare lower olefins from a Fischer-Tropsch synthesis product by performing the following steps:

(a) evaporating part of the product in the presence of a dilution gas stream in a gas and a liquid fraction and separating the liquid fraction from the remaining gas/oil mixture, (b) further heating the gas/oil mixture to an elevated temperature and (c) subjecting the heated gas/oil mixture to a thermal conversion step to obtain the lower olefins.

The process of the invention allows one to feed a hydrocarbon feed comprising a Fischer-Tropsch synthesis product into the convection zone of a pyrolysis furnace without having to decoke the tubes in the convection zone any sooner than the radiant tubes of a furnace. The process of the invention further provides a process wherein the heavy fractions of the feed do not have to be separated from said feed by means of a distillation step. Furthermore a simple atmospheric distillation step typically separates off compounds boiling above 415° C. while the present invention achieves a separation between the gaseous fractions and the liquid fraction above 450° C. This allows more of the initial feed to be sent to the steam cracker while at the same time the liquid coke precursor compounds are effectively removed from the pyrolysis furnace feed.

DETAILED DESCRIPTION OF THE INVENTION

The process according to the present invention uses a Fischer-Tropsch synthesis product in step (a) as feed. The Fischer-Tropsch synthesis product may be present on its own as a 100% Fischer-Tropsch derived feed or in admixture with other suitable feedstocks that can be used in a pyrolysis furnace. Preferred additional feedstocks used in step (a) are light crude oil feedstocks, which have the following characteristics. Each boiling range characterization of the feedstock is measured according to ASTM D-2887: 85 wt % or less and preferably 65 wt % or less of the feedstock will vaporize at 350° C., and 90 wt % or less or preferably 75 wt % or less of the feedstock will vaporize at 400° C. Typical preferred crude oil feedstocks will have API gravities smaller than 45. Feedstocks within the above range of characteristics minimize coking within the tubes of the convection section of a pyrolysis furnace under the operating conditions described herein.

Suitable examples of other suitable feedstocks which can be present next to the Fischer-Tropsch derived feed are mineral oil derived naphtha, kerosene and gas oil. Preferably the additional source is a crude oil feedstock or the long residue of a crude oil atmospheric distillation or a gas field condensate. Examples of suitable crude sources for the present invention are so-called waxy crudes, for example Gippsland, Bu Attifel, Bombay High, Minas, Cinta, Taching, Udang, Sirikit and Handil. Such feedstocks will contain so-called pitch, which will be removed effectively by the process according to the present invention as the liquid fraction. Co-processing a crude oil feed or a gas field condensate product in combination with a Fischer-Tropsch derived product is advantageous because high yields to lower olefins can be achieved in combination with logistic advantages and longer furnace run lengths. Fischer-Tropsch synthesis processes run typically on natural gas in remote regions where also crude oil is found. By co-processing these hydrocarbon sources, logistic and fouling problems are overcome.

The bottoms of an atmospheric distillation column used to process and fractionate desalted crude oil, are commonly known as atmospheric tower bottoms or long residue. This atmospheric distillation column separates diesel, kerosene, naphtha, gasoline, and lighter components from the crude. Long residues can be advantageously admixed with the Fischer-Tropsch product. Preferred properties of the long residues are that 35 wt % or less, more preferably 15 wt % or less, and even 10 wt % or less vaporizes at 350° C., and 55 wt % or less, more preferably 40 wt %, and even 30 wt % or less, vaporizes at 400° C.

The Fischer-Tropsch derived product may be suitably a so called syncrude as described in for example GB-A-2386607 GB-A-2371807 or EP-A-0321305. Other suitable Fischer- Tropsch products may be, optionally hydrotreated, fractions boiling in the naphtha, kerosene or gas oil range, as directly obtained from the Fischer-Tropsch synthesis wax. Preferably part of the Fischer-Tropsch product has been obtained by hydroisomerisation of a Fischer-Tropsch synthesis wax product. The naphtha, kerosene and gas oil fractions obtained in such a hydroisomerisation may also be used as the Fischer-Tropsch product. If the relatively lower boiling Fischer-Tropsch products are used as described above then the feed will also comprise a mineral oil derived fraction such as a crude, an atmospheric long residue or a gas field condensate, such that the preferred properties of the feed with respect to the fractions vaporizing at 350° C. and 400° C. are met.

The higher boiling fractions as obtained in the hydroisomerisation may also be used as the Fischer-Tropsch product in step (a), either alone or in admixture with another component as described above. Preferably the Fischer-Tropsch product could be the full range effluent as obtained in hydroisomerisation of a Fischer-Tropsch wax. Such a full boiling range product preferably comprises compounds having 5 carbon atoms, ranging to compounds having a boiling point exceeding 600° C. More preferably a fraction of this hydroisomerisation effluent having a 50 wt % recovery point (the 50th percentile of the boiling point distribution, as measured by ASTM D2887, of above 250° C., preferably above 290° C. Examples of such a product is the entire residual fraction isolated from the hydroisomerisation effluent, the Waxy Raffinate product as is marketed by Shell MDS (Malaysia) Sdn Bhd or the waxy raffinate product as obtained by the process described in WO-A-02070630 or in EP-B-0668342. These higher boiling Fischer-Tropsch derived feedstocks may be used alone in step (a) or in admixture with the above referred to crude oil, long residue or field condensates or alternatively with refined mineral oil naphtha, kerosene or gas oil. The weight fraction of the Fischer-Tropsch derived feed is preferably above 30 wt %, more preferably above 50 wt % and even more preferably above 70 wt %. The upper limit may be 100% Fischer-Tropsch derived feedstock. This may be the case when no mineral source is available. In such cases sulphur is added as for example DMDS as described above. Applicants further found that this relatively heavy Fischer-Tropsch feedstock will yield more propylene than a lighter Fischer-Tropsch derived naphtha feedstock at the same methane yield. Applicants found that this is also observed under conditions wherein a step (a) is not performed. Therefore the invention is also directed to the preparation of propylene by thermal cracking of the above heavy Fischer-Tropsch feedstock under the conditions generally described in this application.

The Fischer-Tropsch synthesis wax may be obtained by well-known processes, for example the so-called commercial Sasol process, the Shell Middle Distillate Synthesis Process (SMDS) or by the non-commercial Exxon process. These and other processes are for example described in more detail in EP-A-776959, EP-A-668342, U.S. Pat. No. 4,943,672, U.S. Pat. No. 5,059,299, WO-A-9934917 and WO-A-9920720. Typically these Fischer-Tropsch synthesis products will comprise hydrocarbons having 1 to 100 and even more than 100 carbon atoms. The hydrocarbon product will comprise normal paraffins, iso-paraffins, oxygenated products and unsaturated products. The content of aromatics will be lower than 10 wt %, preferably lower than 5 wt %. The content of naphthenic compounds will be lower than 10 wt % and preferably lower than 5 wt %. This Fischer-Tropsch wax or synthesis product is preferably subjected to a hydroisomerisation in order to obtain a high boiling feed, which is easier to transport. In such a process normal paraffins will crack to lower boiling compounds and/or isomerize to iso-paraffins, oxygenates and olefins will saturate to paraffins. Paraffins may be reformed to aromatics, which may be hydrogenated to naphthenes. Lower boiling fractions may be used directly as feed in the process according to the present invention. Examples of suitable hydroisomerisation processes are described in the afore mentioned patent publications and in WO-A-02070630 or in EP-B-0668342.

The Fischer-Tropsch reaction converts carbon monoxide and hydrogen into longer chain, usually paraffinic, hydrocarbons:

$$n(CO+2H2)=(—CH2—)n+nH2O+heat,$$

in the presence of an appropriate catalyst and typically at elevated temperatures, for example 125 to 300° C., preferably 175 to 250° C., and/or pressures, for example 5 to 100 bar, preferably 12 to 80 bar. Typical catalysts for the Fischer-Tropsch synthesis of paraffinic hydrocarbons comprise, as the catalytically active component, a metal from Group VIII of the periodic table, in particular ruthenium, iron, cobalt or nickel.

The mixture of carbon monoxide and hydrogen may be prepared by any of the below carbonaceous feedstocks which are capable of being converted to a mixture of hydrogen and carbon monoxide. Examples of such feedstocks are coal, for example anthracite, brown coal, bitumous coal, sub-bitumous coal, lignite and petroleum coke, bituminous oils, for example ORIMULSION (trade mark of Intevep S. A., Venezuela), biomass, for example woodchips, mineral crude oil or fractions thereof, for example residual fractions of said crude oil, and methane containing feedstocks, for example refinery gas, coal bed gas, associated gas, natural gas. The syngas manufacturing processes to convert such feedstocks to mixtures of carbon monoxide and hydrogen are well known and described in "Gasification" by C. Higman and M van der Burgt, Elsevier Science (USA), 2003, ISBN 0-7506-7707-4, chapter 4 and 5. Preferably, when processing an ash containing feed like coal or petroleum coke the process is performed by a non-catalyzed partial oxidation process as for example the Shell Coal Gasification Process as described in said reference book. If the feedstock is a residual fraction of a crude oil, the preferred process is to use a non-catalyzed partial oxidation as for example the Shell Gasification Process, as for example described in said reference book and also by Heurich et al. in "Partial Oxidation in the Refinery Hydrogen Management Scheme", AIChE 1993 Spring Meeting, Houston, 30 Mar. 1993, and the TEXACO process, as described in Petroleum Review June 1990, page 311-314. In a preferred embodiment the syngas process is performed starting from a gaseous hydrocarbon feed, more preferably a methane containing feed, even more preferably natural gas.

Starting from a gaseous hydrocarbon feed, more processes may be used to prepare the mixture of carbon monoxide and hydrogen. Suitable processes are reforming, steam reforming, autothermal steam reforming, convective steam reforming, catalyzed or non-catalyzed partial oxidation and combinations of said processes. Such processes are for example described in U.S. Pat. No. 4,836,831, EP-A-759886, EP-A-772568, U.S. Pat. No. 5,803,724 U.S. Pat. No. 5,931,978, WO-A-03036166, WO-A-2004092060, WO-A-2004092061, WO-A-2004092062 and WO-A-2004092063. If required the hydrogen to carbon monoxide molar ratio as obtained in the above syngas processes is adapted for the specific Fischer-Tropsch catalyst and process. The $H_2/CO$ molar ratio in syngas formed by gasification is generally about or less than 1, and is commonly about 0.3-0.6 for coal-derived syngas, and 0.5-0.9 for heavy residue-derived syngas. It is possible to use such a $H_2$/CO ratio in the Fischer-Tropsch synthesis, but more satisfactory results can be achieved by increasing the $H_2$/CO ratio. This can be suitably performed by a water gas shift reaction or by adding hydrogen to the syngas mixture. Preferably the $H_2$/CO ratio in the syngas stream formed by the combination of the sub-streams is greater than 1.5, preferably in the range 1.6-1.9, and more preferably in the range 1.6-1.8.

The pressure and temperature in step (a) is not critical so long as the feedstock is flowable. The pressure generally ranges from between 7 and 30 bar, more preferably from 11 and 17 bar, and the temperature of feedstock is generally set from ambient to 300° C., preferably from 140° C.-300° C., Preferably step (a) is performed in the first stage preheater in the convection zone of a pyrolysis furnace. Feed rates are not critical, although it would be desirable to conduct a process at a feedrate ranging from 17 to 200 and more preferably from 25 to 50 tons of feedstock per hour. The first stage preheater in the convection section is typically a bank of tubes, wherein the contents in the tubes are heated primarily by convective heat transfer from the combustion gas exiting from the radiant section of the pyrolysis furnace. In one embodiment, as the feedstock travels through the first stage preheater, it is heated to a temperature which promotes evaporation of non-coking fractions into a vapor state and evaporation of a portion of coking fractions into a vapor state, while maintaining the remainder of the coking fractions in a liquid state. We have found that with a feedstock comprising a Fischer-Tropsch feedstock, it is desirable to fully evaporate the feed fraction which does not promote coking in the first stage preheaters, and in addition, maintain a temperature sufficiently elevated to further evaporate a portion of the feedstock compounds comprised of fractions which promote coking of the tubes in the first stage preheater and/or the second stage preheater. The coking phenomenon in the first stage preheater tubes is substantially diminished by maintaining a wet surface on the walls of the heating tubes. So long as the heating surfaces are wetted at a sufficient liquid superficial velocity, the coking of those surfaces is inhibited.

The optimal temperature at which the feedstock is heated in the first stage preheater of the convection zone will depend upon the particular feedstock composition, the pressure of the feedstock in the first stage preheater, and the performance and operation of the vapor/liquid separator. In one embodiment of the invention, the feedstock is heated in the first stage preheater to an exit temperature of at least 375° C., and more preferably to an exit temperature of at least 400° C. In one embodiment, the exit temperature of the feedstock from the first stage preheater is at least 415° C. Preferably, the exit temperature of the feedstock within the first stage preheater is not more than about 520° C., and most preferably not more than 500° C.

Each of the temperatures identified above in the first stage preheater are measured as the temperature the gas-liquid mixture attains at any point within the first stage preheater, including the exit port of the first stage preheater. Recognizing that the temperature of the feedstock inside the tubes of the first stage preheater changes over a continuum, generally rising, as the feedstock flows through the tubes up to the temperature at which it exits the first stage preheater, it is desirable to measure the temperature at the exit port of the first stage preheater from the convection zone of the furnace. At these exit temperatures, a coke promoting fraction will be evaporated into a gas phase, while maintaining the remainder of the coke promoting fraction in a liquid phase in order to adequately wet the walls of all heating surfaces. The gas-liquid ratio after evaporation in step (a) is preferably in the range from 60/40-98/2 by weight, more preferably 90/10-95/5, by weight, in order to maintain a sufficiently wetted tube wall, minimize coking, and promote increased yields.

In an optional but preferred embodiment of the invention, a feed of dilution gas may be added to the feedstock in the first stage preheater at any point prior to the exit of the gas-liquid mixture from the first stage preheater. In a more preferred embodiment, dilution gas is added to the feedstock of the first stage preheater at a point external to the pyrolysis furnace for ease of maintaining and replacing equipment.

The feed of dilution gas is a stream which is a vapor at the injection point into the first stage preheater. Any gas can be used which promotes the evaporation of non-coking fractions and a portion of coking fractions in the feedstock. The dilution gas feed also assists in maintaining the flow regime of the feedstock through the tubes, whereby the tubes remain wetted, and avoids a stratified flow. Examples of dilution gases are dilution steam (saturated steam at its dewpoint), methane, ethane, nitrogen, hydrogen, natural gas, dry gas, refinery off gases, or a vaporized naphtha. Preferably, the dilution gas is dilution steam, carbon dioxide, hydrogen/carbon monoxide mixtures, also referred to as synthesis gas, a refinery off gas, a gas-to-liquids plant off-gas, more preferably a propane comprising off-gas, vaporized naphtha, or mixtures thereof.

The use of a gas-to-liquids plant off-gas, carbon dioxide or synthesis gas can be advantageous if the gas-to-liquids facility and step (c) of the process according the present invention, e.g. the pyrolysis furnace(s), are located close enough to benefit from a synergy. In such a situation even more preferably use is made of the excess synthesis gas, which is contaminated with carbon dioxide and/or methane as obtained after performing the Fischer-Tropsch synthesis reaction. In the cold box of the olefin process, purified synthesis gas will then be advantageously obtained, which synthesis gas is available at sufficient pressure to be further compressed economically, and recycled to the Fischer-Tropsch synthesis step of such a combined process, or to the synthesis gas manufacturing step.

If carbon dioxide is used as dilution gas part of the carbon dioxide will be converted to carbon monoxide in the thermal cracking step (c). Carbon dioxide is preferably separated from the cracked effluent in the $CO_2$ absorber, which is located upstream of, or integrated with, the olefin process' cracked gas compressor. The carbon dioxide is preferably recycled to step (a). The carbon monoxide and hydrogen is preferably separated from the cracked gas as a mixture of methane, carbon monoxide, and hydrogen. This mixture may be advantageously recycled to the syngas manufacturing step of a gas-to-liquids process. Examples of such syngas manufacturing processes are the catalytic or non-catalytic partial oxidation, autothermal steam reforming, traditional steam reforming, or convective steam reforming or combinations of said processes.

The invention is thus also directed to a process to make ethylene and/or propylene from methane by performing the following steps, (aa) preparing a mixture of carbon monoxide and hydrogen from a carbonaceous feedstock, preferably methane, (bb) performing a Fischer-Tropsch synthesis step using the gaseous mixture obtained in step (aa) to obtain a Fischer-Tropsch product, (cc) performing a thermal cracking step on the Fischer-Tropsch product using a dilution gas in step (a), comprising the unconverted carbon monoxide and hydrogen or carbon dioxide or mixtures of said gases, (dd) isolating a mixture of methane, carbon monoxide and hydrogen from the cracked gases obtained in step (cc) and (ee) recycling the mixture of methane, carbon monoxide and hydrogen to step (aa). Preferably step (cc) is performed according to the process of the invention described herebefore. In such preferred embodiment the liquid fraction as obtained in step (a) is preferably subjected to a hydroconversion/hydroisomerisation step yielding an effluent which may as a whole or in part be used as additional feed in step (a).

The conditions, processes, feedstocks and preferred embodiments for steps (aa) and (bb) are those described earlier in this description.

The temperature of the dilution gas is at a minimum sufficient to maintain the stream in a gaseous state. With respect to dilution gas, it is preferably added at a temperature below the temperature of the crude oil feedstock measured at the injection point to ensure that any water, which may be the dilution gas itself or may be present as contaminant in some of the above referred to dilution gases, does not condense. This temperature is more preferably 25° C. below the feedstock temperature at the injection point. Typical dilution gas temperatures at the dilution gas/feedstock junction range from 140° C. to 260° C., more preferably from 150° C. to 200° C.

The pressure of dilution gas is not particularly limited, but is preferably sufficient to allow injection. Typical dilution gas pressures added to the crude oil is generally within the range of 6 to 15 bar.

It is desirable to add dilution gas into the first stage preheater in an amount up to 0.5:1 kg of gas per kg of crude oil, preferably up to 0.3:1 kg of gas per kg of crude oil and/or long residue feedstock.

Once the hydrocarbon feedstock has been heated to produce a gas-liquid mixture, it is withdrawn from the first stage preheater directly or indirectly to a vapor/liquid separator as a heated gas-liquid mixture. The vapor/liquid separator removes the non-vaporized portion of the feedstock, which is withdrawn and separated from the fully vaporized gases of the feedstock. The vapor/liquid separator can be any separator, including a cyclone separator, a centrifuge, or a fractionation device commonly used in heavy oil processing. The vapor/liquid separator can be configured to accept side entry feed wherein the vapor exits the top of the separator and the liquids exit the bottom of the separator, or a top entry feed wherein the product gases exit the side of the separator.

The vapor/liquid separator operating temperature is sufficient to maintain the temperature of the gas-liquid mixture within the range of 375° C. to 520° C., preferably within the range of 400° C. to 500° C. The vapor/liquid temperature can be adjusted by any means, including increasing a flow of superheated dilution gas to the gas-liquid mixture destined for the vapor/liquid separator and/or by increasing the temperature of the feedstock to the furnace from external heat exchangers. In a preferred embodiment, the vapor/liquid separator is used as described in U.S. Pat. No. 6,376,732, which publication is incorporated by reference.

The gaseous vaporized portion of the feed, as fed to the vapor/liquid separator as a gas-liquid mixture from the first stage preheater, is preferably and subsequently fed through a vaporizer mixer in which the vapor mixes with superheated gas, preferably superheated steam, to heat the vapor to a higher temperature. The vapor is desirably mixed with superheated gas, in order to ensure that the stream remains in a gaseous state by, lowering the partial pressure of the hydrocarbons in the vapor. Since the vapor exiting the vapor/liquid separator is saturated, the addition of superheated gas will minimize the potential for coking fractions in the vapor to condense on inner surfaces of the unheated external piping connecting the vapor/liquid separator to the second stage preheater. Suitable superheated gas temperatures are not particularly limited at the high end, and is suitably sufficient to provide superheating above the dew point of the vapor. Generally, the superheated gas is introduced to the vaporizer mixer at a temperature ranging from about 450° C. to 600° C.

The vaporizer mixer is preferably located externally to the pyrolysis furnace, again for ease of maintenance. Any conventional mix nozzle may be used, but it is preferred to use a mix nozzle as described in U.S. Pat. No. 4,498,629, which document is fully incorporated herein by reference.

In case the process is operated on a substantially Fischer-Tropsch derived feed, some sulphur is preferably added to the feed. In a preferred embodiment, the sulphur component, for example DMDS, is added after performing step (a) and before step (b). This is advantageous because then no sulphur will be added to the liquid fraction obtained in step (a). This sulphur free high boiling Fischer-Tropsch product may be advantageously recycled to a hydroconversion/hydroisomerisation step of the gas-to-liquids production facility without said facility being contaminated by sulphur.

The gas/gas mixture as obtained in step (a) is further increased in temperature in step (b). Preferably the gas/gas mixture has a starting temperature in step (b) of 480° C., more preferably at least 510° C., most preferably at least 535° C. The temperature of the gas/gas mixture after performing step (b) is preferably at least 730° C., more preferably at least 760° C. and most preferably between 760° C. and 815° C. Step (b) is preferably performed in the second stage preheater of a pyrolysis furnace. In the second stage preheater, the gas/gas mixture flows through tubes heated by the flue gases from the radiant section of the furnace. In the second stage preheater the mixed gas/gas mixture is fully preheated to near or just below a temperature at which substantial feedstock cracking and associated coke laydown in the preheater would occur. The heated mixture is used in step (c).

Step (c) is preferably performed in the radiant section of an olefins pyrolysis furnace where the gaseous hydrocarbons are thermally cracked to olefins and associated by products. Products of an olefins pyrolysis furnace include, but are not limited to, ethylene, propylene, butadiene, benzene, hydrogen, and methane, and other associated olefinic, paraffinic, and aromatic products. Ethylene is the predominant product, typically ranging from 15 to 40 wt %, based on the weight of the vaporized feedstock. The second important product is propylene. When reference is made to lower olefins, ethylene, propylene and $C_4$-olefins are meant.

The pyrolysis furnace may be any type of conventional olefins pyrolysis furnace operated for production of lower molecular weight olefins, especially including a tubular gas cracking furnace. The tubes within the convection zone of the pyrolysis furnace may be arranged as a bank of tubes in parallel, or the tubes may be arranged for a single pass of the feedstock through the convection zone. At the inlet, the feedstock may be split among several single pass tubes, or may be fed to one single pass tube through which all the feedstock flows from the inlet to the outlet of the first stage preheater, and more preferably through the whole of the convection zone. Preferably, the first stage preheater is comprised of one single pass bank of tubes disposed in the convection zone of the pyrolysis furnace. In this preferred embodiment, the convection zone comprises a single pass tube having two or more banks through which the feed flows. Within each bank, the tubes may arranged in a coil or serpentine type arrangement within one row, and each bank may have several rows of tubes.

To further minimize coking in the tubes of the first stage preheater and in tubes further downstream and within the vapor/liquid separator, the superficial velocity of the feedstock flow should be selected to reduce the residence time of coking fraction vaporized gases in the tubes. An appropriate superficial velocity will also promote formation of a thin uniform wetted tube surface. While higher superficial velocities of feedstock through the tubes of the first stage preheater reduce the rate of coking, there is an optimum range of superficial velocity for a particular feedstock beyond which the beneficial rates of coke reduction begin to diminish in view of the extra energy requirements needed to pump the feedstock and the sizing requirements of the tubes to accommodate a higher than optimum velocity range. In general, feedstock superficial velocity through the tubes of the first stage preheater in a convection section ranging from 1.1-2.2 m/s, more preferably from 1.7-2.1 m/s, and most preferably from 1.9-2.1 m/s, provide optimal results in terms of reducing the coking phenomenon balance against the cost of the tubes in furnace and the energy requirements.

The temperature of the product gas mixture in step (c) is preferably between 750 and 860° C. This latter temperature is sometimes referred to as the coil outlet temperature. The temperature of this gas is quickly reduced to terminate any unwanted reactions to a temperature of below 300° C. Examples of reducing the temperature are by means of well known transfer line exchangers and/or by means of a quench oil fitting. Preferably the temperature is reduced to below 440° C. by means of a transfer line exchanger and further reduced to below 240° C. by means of a quench oil fitting. The product gas or cracked gas is further separated into the different products as listed above by well known and described processes known to the skilled person.

EXAMPLE 1

A Fischer-Tropsch wax of which 10 wt % boils above 620° C. was contacted with steam and heated to a temperature of 480° C. A steam/hydrocarbon mixture was obtained wherein the hydrocarbons had the properties as listed in Table 1.

| | |
|---|---|
| Liquid Density (d70/4) (g/ml) | 0.7397 |
| Sulphur (wt %) | <0.0010 |
| Initial boiling point (° C.) | 78 |
| 10 wt % (° C.) | 158 |
| 50 wt % (° C.) | 302 |
| 90 wt % (° C.) | 480 |
| 98 wt % (° C.) | 700 |

The steam/hydrocarbon mixture was thermally cracked at a flow of 52 g/h hydrocarbons and at a steam flow of 43.7 Nl/h, a pressure of 2.15 bar absolute pressure and with a coil outlet temperature of between 800 and 860° C. The results are presented in Table 3.

Comparative Experiment A

Example 1 was repeated with a naphtha having the properties as listed in Table 2:

TABLE 2

| | |
|---|---|
| Density (d20/4) (g/ml) | 0.7198 |
| Initial boiling point (° C.) | 3 |
| 10 wt % (° C.) | 58 |
| 50 wt % (° C.) | 101 |

TABLE 2-continued

| | |
|---|---|
| 90 wt % (° C.) | 154 |
| 98 wt % (° C.) | 176 |
| Paraffins (wt %) | 61 |
| naphthenics | 24 |
| aromatics | 14 |
| Olefins | 1 |

TABLE 3

| Feed | Example 1 | Example 1 | Example 1 | Naphtha; Exp. A |
|---|---|---|---|---|
| Coil outlet temperature | 800 | 840 | 860 | 840 |
| Hydrogen (wt %) | 0.5 | 0.7 | 0.9 | 0.9 |
| Methane | 9.3 | 12.6 | 13.9 | 14.2 |
| Ethane | 3.6 | 3.3 | 3.0 | 3.3 |
| Ethylene | 30.9 | 35.4 | 36.6 | 28.4 |
| Propane | 0.7 | 0.5 | 0.4 | 0.4 |
| Propylene | 18.5 | 15.2 | 12.5 | 13.0 |
| $C_5$ minus | 86 | 83 | 80 | 72 |

The results in Table 3 show that excellent yields can be obtained with the relatively heavy Fischer-Tropsch synthesis product using the process according the invention. The results also show that with a much heavier Fischer-Tropsch feed a much higher yield to the $C_5$ minus range of compounds is achieved. This is surprising.

What is claimed is:

1. A process to make ethylene and/or propylene from methane comprising:

(aa) preparing a gaseous mixture of carbon monoxide and hydrogen from methane;

(bb) performing a Fischer-Tropsch synthesis step using the gaseous mixture obtained in step (aa) to obtain a Fischer-Tropsch product having a 50 wt % recovery point above 250° C.;

(cc) evaporating in a step (a) part of the Fischer-Tropsch product in the presence of a dilution gas comprising the unconverted carbon monoxide and hydrogen of step (bb) and carbon dioxide in a gas and a liquid fraction and separating the liquid fraction from the remaining gas fraction, further heating the gas fraction to an elevated temperature of between 730 and 815° C. in a step (b) and subjecting the heated gas fraction to a thermal cracking step (c) at a temperature of between 750 and 860° C. to obtain ethylene and/or propylene;

(dd) isolating a mixture of methane, carbon monoxide and hydrogen from the cracked gasses obtained in step (cc); and (ee) recycling the mixture of methane, carbon monoxide and hydrogen to step (aa).

2. A process according to claim 1, wherein carbon dioxide is separated from the cracked gasses in a $CO_2$ absorber and recycled to step (a) to be used as dilution gas.

3. A process according to claim 1, wherein the 85 wt % of the Fischer-Tropsch product in step (cc) will vaporize at 350° C.

4. A process according to claim 1, wherein the feed to step (a) also comprises atmospheric tower bottoms of a desalted crude oil.

5. A process according to claim 1, wherein evaporation of the liquid Fischer-Tropsch product in step (a) is performed in the first stage pre-heater of a pyrolysis furnace, step (b) is performed in a second stage pre-heater of a pyrolysis furnace and step(c) is performed in the radiant section of a pyrolysis furnace.

6. A process according to claim 1, wherein the liquid fraction obtained in step (a) is subjected to a hydroconversion/hydroisomerisation step to obtain an effluent, which is recycled to step (a).

7. A process according to claim 1, wherein the Fischer-Tropsch product has a 50 wt % recovery point above 290° C.

8. A process according to claim 1, wherein the feed to step (*a*) also comprises a gas field *condensate*.

* * * * *